US007160519B1

(12) United States Patent
Norby et al.

(10) Patent No.: US 7,160,519 B1
(45) Date of Patent: Jan. 9, 2007

(54) SERVICEABLE EXHAUST AFTERTREATMENT DEVICE, AND CONFIGURED CYLINDRICAL BODIES FOR COUPLING

(75) Inventors: Duane E. Norby, Evansville, WI (US); Robert Raymond Petkovsek, Neillsville, WI (US)

(73) Assignee: Fleetguard, Inc., Nashville, TN (US)

( * ) Notice: Subject to any disclaimer, the term of this patent is extended or adjusted under 35 U.S.C. 154(b) by 387 days.

(21) Appl. No.: 10/628,299

(22) Filed: Jul. 28, 2003

(51) Int. Cl.
*F16L 17/00* (2006.01)
*B01D 50/00* (2006.01)

(52) U.S. Cl. ..... 422/168; 285/369; 285/417

(58) Field of Classification Search ..... 422/168, 422/171, 177, 179; 285/369, 417
See application file for complete search history.

(56) References Cited

U.S. PATENT DOCUMENTS

| | | | | |
|---|---|---|---|---|
| 246,597 | A | | 9/1881 | Camp |
| 604,863 | A | | 5/1898 | Hoyer |
| 1,296,016 | A | | 3/1919 | Smith |
| 1,315,904 | A | | 9/1919 | Bever |
| 1,329,479 | A | | 2/1920 | Savon |
| 1,889,795 | A | | 12/1932 | Smith et al. |
| 3,210,102 | A | | 10/1965 | Joslin |
| 4,149,562 | A | * | 4/1979 | Johnson et al. ..... 137/891 |
| 4,239,733 | A | * | 12/1980 | Foster et al. ..... 422/179 |
| 4,257,155 | A | | 3/1981 | Hunter |
| 4,352,408 | A | | 10/1982 | Hardt et al. |
| 4,372,017 | A | | 2/1983 | Heckethorn |
| 4,446,942 | A | | 5/1984 | Hardt et al. |
| 4,473,131 | A | | 9/1984 | Clegg et al. |
| 4,911,484 | A | | 3/1990 | Hackforth |
| 5,169,604 | A | * | 12/1992 | Crothers, Jr. ..... 422/177 |
| 5,957,163 | A | | 9/1999 | Ito et al. |
| 6,877,780 | B1 | * | 4/2005 | Potts et al. ..... 285/420 |

FOREIGN PATENT DOCUMENTS

| | | |
|---|---|---|
| FR | 1224789 | 7/1960 |
| GB | 0027645 | 7/1897 |
| GB | 1597362 | 9/1981 |

* cited by examiner

*Primary Examiner*—Glenn Caldarola
*Assistant Examiner*—Tom P. Duong
(74) *Attorney, Agent, or Firm*—Andrus, Sceales, Starke & Sawall, LLP; J. Bruce Schelkopf

(57) ABSTRACT

A serviceable exhaust aftertreatment device and configured cylindrical bodies for coupling include a raised annular rib or bead structure providing low profile mounting and ease of assembly.

8 Claims, 2 Drawing Sheets

SERVICEABLE EXHAUST AFTERTREATMENT DEVICE, AND CONFIGURED CYLINDRICAL BODIES FOR COUPLING

BACKGROUND AND SUMMARY

The invention relates to serviceable exhaust aftertreatment devices and to cylindrical bodies configured for coupling.

The invention arose during continuing development efforts relating to serviceable exhaust aftertreatment devices, such as diesel particulate filters (DPF), catalytic elements, mufflers, and the like, including various combinations thereof. An exhaust aftertreatment device requires service at predetermined intervals. In such device, one or more central sections are attached to an inlet section and an outlet section, for flow distribution and mechanical construction, typically application dependent. To service a central section, the inlet section and the outlet section must be removed. Existing serviceable exhaust aftertreatment devices require expensive clamps and sophisticated flanges for joining and sealing mating surfaces, such as 90° flanges. Servicing may include replacement with a new or different element, or may involve a re-usable element wherein soot, ash or contaminant build-up is cleaned from the removed element and then the now-cleaned re-usable element is re-installed. The element may include various types of emissions components.

Design requirements include: serviceability, as noted; structural integrity; leak prevention; cost effective manufacturability; and ease of assembly. A further requirement is low profile mountability. Typical designs in the prior art add 0.5 inch or more to the outer diameter of the device (typically having a diameter in the range of 7 inches to 13 inches), to accommodate the added radial height or dimension of a flange or clamp. This extra 0.5 inch is objectionable in various applications where only severely limited space is available.

The present invention addresses and solves the above noted needs in a particularly simple and effective manner. In one embodiment, the invention requires an increase in outer diameter in the range of 1 to 2% to accommodate the coupled bodies, as opposed to 4 to 7% in the prior art. In one particular embodiment, in an exhaust aftertreatment device having a main body outer diameter in the range of 7 to 13 inches, the present invention requires an increase in outer diameter of only 0.125 inch at the coupling of the bodies. In further aspects, the invention facilitates easy removal and replacement of a central section of the exhaust aftertreatment device.

DETAILED DESCRIPTION

Figure 1:
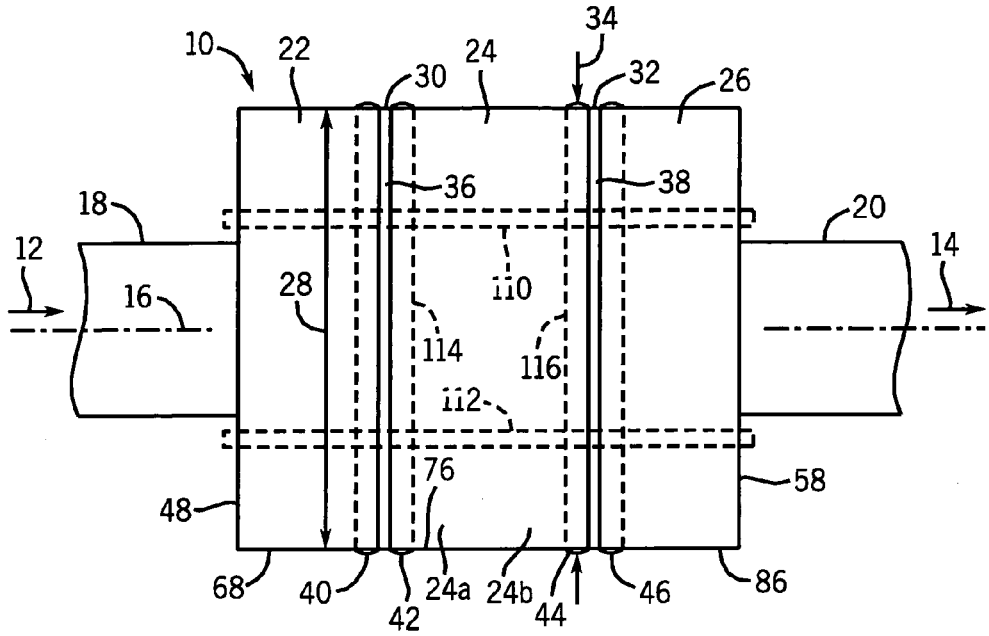
FIG. 1 is a side elevation view of an exhaust aftertreatment device in accordance with the invention.
Figure 3:
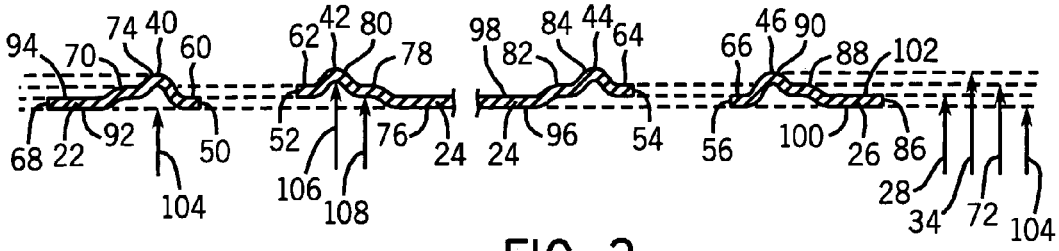
FIG. 3 is a profiled sectional view of the sidewall construction of the exhaust aftertreatment device of FIGS. 1 and 2.
Figure 2:
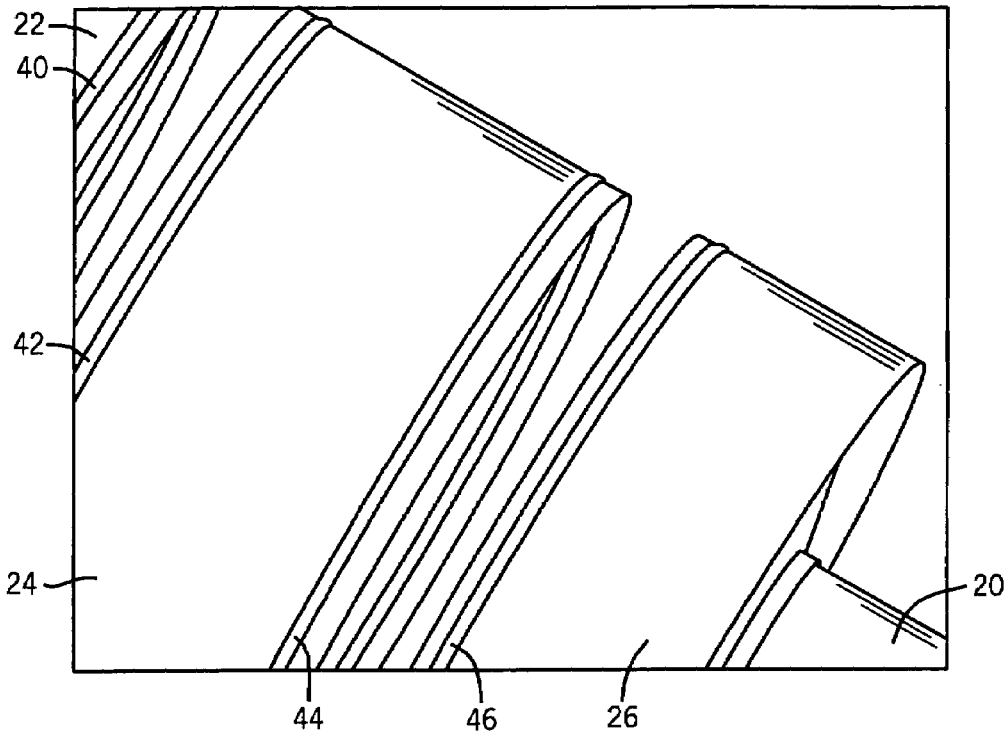
FIG. 2 is an exploded perspective partial view of the device of FIG. 1.

FIGS. 1–3 show a serviceable exhaust aftertreatment device 10 for exhaust flowing as shown at arrows 12, 14 along an axial flowpath 16 from upstream at inlet pipe 18 to downstream at outlet pipe 20. Device 10 includes an inlet cylindrical body 22 providing an inlet section, one or more central cylindrical bodies 24 providing a central section, and an outlet cylindrical body 26 providing an outlet section. The central section provides exhaust aftertreatment, for example as provided by a diesel particulate filter and/or a catalyst and/or a muffler and/or a combination thereof. Cylindrical bodies 22, 24, 26 are axially colinearly aligned along axis 16. Cylindrical body 24 is axially between cylindrical bodies 22 and 26 and is removable therefrom, for servicing, to be described. Each of the cylindrical bodies has a main body outer profile of given outer diameter 28. Cylindrical body 22 mates with cylindrical body 24 at junction 30. Cylindrical body 24 mates with cylindrical body 26 at junction 32. Each of the junctions has an outer profile of increased outer diameter 34, FIGS. 1, 3. The increase in outer diameter from 28 to 34 is less than 2%, and preferably as enabled in the present invention is in the range of 1 to 2%. Further particularly, in an exhaust aftertreatment device having a given outer diameter 28 in the range of 7 to 13 inches, the increase in outer diameter 34 is approximately 0.125 inch.

Cylindrical bodies 22 and 24 are mated and sealed to each other without a gasket therebetween. Cylindrical bodies 24 and 26 are mated and sealed to each other without a gasket therebetween. Cylindrical bodies 22 and 24 are mated and sealed to each other along an axially extending annulus 36. Cylindrical bodies 24 and 26 are mated and sealed to each other along a second axially extending annulus 38. Cylindrical bodies 22 and 24 have first and second structurally rigidizing annular beads 40 and 42, respectively, at axially distally opposite upstream and downstream ends of annulus 36. Cylindrical bodies 24 and 26 have third and fourth structurally rigidizing annular beads 44 and 46, respectively, at axially distally opposite upstream and downstream ends of annulus 38. Beads 40, 42, 44, 46 are provided by respective raised annular ribs providing the respective structural rigidizing beads. First and second beads or ribs 40 and 42 are axially nonoverlapped in assembled condition, and are axially spaced by annulus 36 therebetween in assembled condition. Beads or ribs 44 and 46 are axially nonoverlapped in assembled condition, and are axially spaced by annulus 38 therebetween in assembled condition.

Cylindrical body 22 has distally opposite upstream and downstream axial ends 48 and 50. Cylindrical body 24 has distally opposite upstream and downstream axial ends 52 and 54. Cylindrical body 26 has distally opposite upstream and downstream axial ends 56 and 58. Downstream end 50 of cylindrical body 22 engages upstream end 52 of cylindrical body 24 in axial sliding telescoped relation. Downstream end 54 of cylindrical body 24 engages upstream end 56 of cylindrical body 26 in axial sliding telescoped relation. Exhaust aftertreatment device 10 is serviced by axially sliding cylindrical bodies 22 and 24 away from each other and axially sliding cylindrical bodies 24 and 26 away from each other. Central section 24 is then removed and replaced by a replacement exhaust aftertreatment section, which may be a new section, or may be the same section cleaned and re-used, and the cylindrical bodies are axially slid towards each other into the noted axial sliding telescoped engagement.

Downstream end 50 of cylindrical body 22 has the noted beaded construction provided by raised annular rib 40 of increased radial height 34, and has an annular flange 60 extending axially downstream from rib 40. Upstream end 52 of cylindrical body 24 has the noted beaded construction provided by raised annular rib 42 of increased radial height 34, and has a second annular flange 62 extending axially upstream from rib 42. Downstream end 54 of cylindrical body 24 has the noted beaded construction provided by third raised annular rib 44 of the noted increased radial height 34, and has a third annular flange 64 extending axially downstream from rib 44. Upstream end 56 of cylindrical body 26 has the noted beaded construction provided by fourth raised annular rib 46 of the noted increased radial height 34, and has a fourth annular flange 66 extending axially upstream from rib 46. First and second annular flanges 60 and 62 engage in axial sliding telescoped relation without overlap of first and second raised annular ribs 40 and 42. Third and fourth annular flanges 64 and 66 engage in axial sliding telescoped relation without axial overlap of third and fourth annular ribs 44 and 46. This permits servicing of exhaust aftertreatment device 10 by axial withdrawal and insertion of the cylindrical bodies.

Cylindrical body 22 has an axially extending sidewall 68 having a double shoulder construction including a first raised shoulder 70 of first increased radial height 72, and a second raised shoulder 74 of second increased radial height 34. Second raised shoulder 74 provides the noted first raised annular rib 40. Second increased radial height 34 is greater than first increased radial height 72. Cylindrical body 24 has an axially extending sidewall 76 having a double shoulder construction at upstream end 52 including a third raised shoulder 78 of increased radial height 72, and a fourth raised shoulder 80 of increased radial height 34. Fourth raised shoulder 80 provides the noted second raised annular rib 42. Increased radial height 34 at shoulder 80 is greater than increased radial height 72 at shoulder 78. Sidewall 76 of cylindrical body 24 has another double shoulder construction at downstream end 54 including a fifth raised shoulder 82 of increased radial height 72, and a sixth raised shoulder 84 of increased radial height 34. Raised shoulder 84 provides the noted third raised annular rib 44. Increased radial height 34 at shoulder 84 is greater than increased radial height 72 at shoulder 82. Cylindrical body 26 has an axially extending sidewall 86 having a double shoulder construction including a seventh raised shoulder 88 of increased radial height 72, and an eighth raised shoulder 90 of increased radial height 34. Raised shoulder 90 provides the noted fourth raised annular rib 46. Increased radial height 34 at shoulder 90 is greater than increased radial height 72 at shoulder 88.

Cylindrical body sidewall 68 has inner and outer surfaces 92 and 94. Outer surface 94 of cylindrical body sidewall 68 at flange 60 has a radial height 28 less than the radial height 34 of outer surface 94 of cylindrical body sidewall 68 at shoulder 74 and less than or equal to the radial height 72 of outer surface 94 of cylindrical body sidewall 68 at shoulder 70. Cylindrical body sidewall 76 has inner and outer surfaces 96 and 98. Outer surface 98 of cylindrical body sidewall 76 at flange 62 has a radial height 72 less than the radial height 34 of outer surface 98 of cylindrical body sidewall 76 at shoulder 80 and less than or equal to radial height 72 of outer surface 98 of cylindrical body sidewall 76 at shoulder 78. Outer surface 98 of cylindrical body sidewall 76 at flange 64 has a radial height 72 less than the radial height 34 of outer surface 98 of cylindrical body sidewall 76 at shoulder 84 and less than or equal to the radial height 72 of outer surface 98 of cylindrical body sidewall 76 at shoulder 82. Cylindrical body sidewall 86 has inner and outer surfaces 100 and 102. Outer surface 102 of cylindrical body sidewall 86 at flange 66 has a radial height 28 less than the radial height 34 of outer surface 102 of cylindrical body sidewall 86 at shoulder 90 and less than or equal to the radial height 72 of outer surface 102 of cylindrical body sidewall 86 at shoulder 88.

Inner surface 92 of cylindrical body sidewall 68 has a radial height 104 less than the radial height 106 of inner surface 92 of cylindrical body sidewall 68 at shoulder 74 and less than or equal to the radial height 108 of inner surface 92 of cylindrical body sidewall 68 at shoulder 70. Inner surface 96 of cylindrical body sidewall 76 at flange 62 has a radial height 108 less than the radial height 106 of inner surface 96 of cylindrical body sidewall 76 at shoulder 80 and less than or equal to the radial height 108 of inner surface 96 of cylindrical body sidewall 76 at shoulder 78. Inner surface 96 of cylindrical body sidewall 76 at flange 64 has a radial height 108 less than the radial height 106 of inner surface 96 of cylindrical body sidewall 76 at shoulder 84 and less than or equal to the radial height 108 of inner surface 96 of cylindrical body sidewall 76 at shoulder 82. Inner surface 100 of cylindrical body sidewall 86 at flange 66 has a radial height 104 less than the radial height 106 of inner surface 100 of cylindrical body sidewall 86 at shoulder 90 and less than or equal to the radial height 108 of inner surface 100 of cylindrical body sidewall 86 at shoulder 88.

In the preferred embodiment, the noted first, third, fifth and seventh increased radial heights at the noted respective first, third, fifth and seventh shoulders 70, 78, 82, 88 are substantially equal to each other. Further in the preferred embodiment, the noted second, fourth, sixth and eighth increased radial heights at the noted respective second, fourth, sixth and eighth shoulders 74, 80, 84, 90 are substantially equal to each other.

In further embodiments, the noted central section includes plural central cylindrical bodies, such as 24*a* and 24*b*, coupled to each other by the above described raised rib beaded coupling configuration comparable to that at annulus 36 and at annulus 38. Cylindrical bodies 22, 24*a*, 24*b*, 26 are axially colinearily aligned along axis 16. The plural central cylindrical bodies provide various exhaust aftertreatment functions, such as a diesel particulate filter, a catalyst, a muffler, and the like, and various combinations thereof.

The cylindrical bodies may be held together axially by any suitable means, such as by inlet and outlet pipes 18 and 20 themselves if they are sufficiently rigidly mounted, or by one or more axial clamps such as shown schematically in dashed line at 110, 112, or by circumferential band clamps such as shown in dashed line at 114 around ribs or beads 40 and 42 and spanning annulus 30, and as shown in dashed line at 116 around respective ribs or beads 44 or 46 and spanning annulus 32.

The invention provides a method for servicing exhaust aftertreatment device 10 by axially moving cylindrical bodies 22 and 24 away from each other and axially moving cylindrical bodies 24 and 26 away from each other and removing cylindrical body 24, and then installing a replacement second cylindrical body 24 by axially moving cylindrical body 22 and replacement cylindrical body 24 axially towards each other and into engagement with each other in axial sliding overlapped telescoped relation, and moving replacement cylindrical body 24 and cylindrical body 26 axially towards each other and into engagement with each other in axial sliding overlapped telescoped relation. The method involves axially sliding cylindrical body 22 and replacement cylindrical body 24 into engagement with each other without overlap of annular beads 40 and 42, and axially sliding replacement cylindrical body 24 and cylindrical body 26 into engagement with each other without overlap of annular beads 44 and 46, such that upon the next servicing of exhaust aftertreatment device 10, the cylindrical bodies 22 and 24 may be moved axially away from each other without axial detent interference by annular beads 40 and 42, and cylindrical bodies 24 and 26 may be axially moved away from each other without axial detent interference by annular beads 44 and 46.

It is recognized that various equivalents, alternatives and modifications are possible within the scope of the appended claims.

What is claimed is:

1. A serviceable exhaust aftertreatment device for exhaust flowing axially along an axial flowpath from upstream to downstream, comprising an inlet cylindrical body providing an inlet section, a central cylindrical body providing an exhaust aftertreatment central section and an outlet cylindrical body providing an outlet section, said cylindrical bodies being axially colinearly aligned along said axis, with said central cylindrical body being axially between said inlet and outlet cylindrical bodies and removable therefrom for servicing, said inlet cylindrical body having distally opposite upstream and downstream axial ends, said central cylindrical body having distally opposite upstream and downstream axial ends, said outlet cylindrical body having distally opposite upstream and downstream axial ends, said downstream end of said inlet cylindrical body engaging said upstream end of said central cylindrical body in axial sliding telescoped relation, said downstream end of said central cylindrical body engaging said upstream end of said outlet cylindrical body in axial sliding telescoped relation, such that said exhaust aftertreatment device is serviced by axially sliding said inlet and central cylindrical bodies away from each other and axially sliding said central and outlet cylindrical bodies away from each other, wherein said inlet cylindrical body has an inlet pipe extending axially in a first axial direction therefrom from said upstream axial end thereof, said outlet cylindrical body has an outlet pipe extending axially in a second direction therefrom from said downstream axial end thereof, said first and second axial directions being opposite to each other, said inlet cylindrical body defines an axially extending inlet plenum therealong along an axially extending sidewall, said axially extending sidewall of said inlet cylindrical body extends axially between said distally opposite upstream and downstream axial ends of said inlet cylindrical body, said inlet plenum extends axially between said inlet pipe and said upstream axial end of said central cylindrical body, said outlet cylindrical body defines an axially extending outlet plenum therealong along an axially extending sidewall, said axially extending sidewall of said outlet cylindrical body extends axially between said distally opposite upstream and downstream ends of said outlet cylindrical body, said outlet plenum extends axially between said downstream axial end of said central cylindrical body and said outlet pipe.

2. The exhaust aftertreatment device according to claim 1 wherein said downstream end of said inlet cylindrical body has a beaded construction comprising a first raised annular rib of increased radial height and a first annular flange extending axially downstream therefrom, said upstream end of said central cylindrical body has a beaded construction comprising a second raised annular rib of increased radial height and a second annular flange extending axially upstream therefrom, said downstream end of said central cylindrical body has a beaded construction comprising a third raised annular rib of increased radial height and a third annular flange extending axially downstream therefrom, said upstream end of said outlet cylindrical body has a beaded construction comprising a fourth raised annular rib of increased radial height and a fourth annular flange extending axially upstream therefrom, wherein said first and second annular flanges engage in axial sliding telescoped relation without axial overlap of said first and second raised annular ribs, and said third and fourth annular flanges engage in axial sliding telescoped relation without axial overlap of said third and fourth annular ribs, whereby to permit servicing of said exhaust aftertreatment device by axial withdrawal and insertion of said cylindrical bodies.

3. The exhaust aftertreatment device according to claim 2 wherein said inlet cylindrical body has said axially extending sidewall having a double shoulder construction comprising a first raised shoulder of first increased radial height and a second raised shoulder of second increased radial height, said second raised shoulder providing said first raised annular rib, said second increased radial height being greater than said first increased radial height, said central cylindrical body has an axially extending sidewall having a double shoulder construction at said upstream end comprising a third raised shoulder of third increased radial height and a fourth raised shoulder of fourth increased radial height, said fourth raised shoulder providing said second raised annular rib, said fourth increased radial height being greater than said third increased radial height, said sidewall of said second cylindrical body having another double shoulder construction at said downstream end comprising a fifth raised shoulder of fifth increased radial height and a sixth raised shoulder of sixth increased radial height, said sixth raised shoulder providing said third raised annular rib, said sixth increased radial height being greater than said fifth increased radial height, said outlet cylindrical body has said axially extending sidewall having a double shoulder construction comprising a seventh raised shoulder of seventh increased radial height and an eighth raised shoulder of eighth increased radial height, said eighth raised shoulder providing said fourth raised annular rib, said eighth increased radial height being greater than said seventh increased radial height.

4. The exhaust aftertreatment device according to claim 3 wherein said inlet cylindrical body sidewall has inner and outer surfaces, said outer surface of said inlet cylindrical body sidewall at said first flange has a radial height less than the radial height of said outer surface of said inlet cylindrical body sidewall at said second shoulder and less than or equal to the radial height of said outer surface of said inlet cylindrical body sidewall at said first shoulder, said central cylindrical body sidewall has inner and outer surfaces, said outer surface of said central cylindrical body sidewall at said second flange has a radial height less than the radial height of said outer surface of said central cylindrical body sidewall at said fourth shoulder and less than or equal to the radial height of said outer surface of said central cylindrical body sidewall at said third shoulder, said outer surface of said central cylindrical body sidewall at said third flange has a radial height less than the radial height of said outer surface of said central cylindrical body sidewall at said sixth shoulder and less than or equal to the radial height of said outer surface of said central cylindrical body sidewall at said fifth shoulder, said outlet cylindrical body sidewall has inner and outer surfaces, said outer surface of said outlet cylindrical body sidewall at said fourth flange has a radial height less than the radial height of said outer surface of said outlet cylindrical body sidewall at said eighth shoulder and less than or equal to the radial height of the outer surface of said outlet cylindrical body sidewall at said seventh shoulder.

5. The exhaust aftertreatment device according to claim 3 wherein said inlet cylindrical body sidewall has inner and outer surfaces, said inner surface of said inlet cylindrical body sidewall at said first flange has a radial height less than the radial height of said inner surface of said inlet cylindrical body sidewall at said second shoulder and less than or equal to the radial height of said inner surface of said inlet cylindrical body sidewall at said first shoulder, said central cylindrical body sidewall has inner and outer surfaces, said inner surface of said central cylindrical body sidewall at said second flange has a radial height less than the radial height of said inner surface of said central cylindrical body sidewall at said fourth shoulder and less than or equal to the radial height of said inner surface of said central cylindrical body sidewall at said third shoulder, said inner surface of said central cylindrical body sidewall at said third flange has a radial height less than the radial height of said inner surface of said central cylindrical body sidewall at said sixth shoulder and less than or equal to the radial height of said inner surface of said central cylindrical body sidewall at said fifth shoulder, said outlet cylindrical body sidewall has inner and outer surfaces, said inner surface of said outlet cylindrical body sidewall at said fourth flange has a radial height less than the radial height of said inner surface of said outlet cylindrical body sidewall at said eighth shoulder and less than or equal to the radial height of said inner surface of said outlet cylindrical body sidewall at said seventh shoulder.

6. The exhaust aftertreatment device according to claim 3 wherein said first, third, fifth and seventh increased radial heights are substantially equal to each other, and wherein said second, fourth, sixth and eighth increased radial heights are substantially equal to each other.

7. The exhaust aftertreatment device according to claim 3 wherein said inlet cylindrical body sidewall has inner and outer surfaces, said outer surface of said inlet cylindrical body sidewall at said first flange has a radial height less than the radial height of said outer surface of said inlet cylindrical body sidewall at said second shoulder and less than or equal to the radial height of said outer surface of said inlet cylindrical body sidewall at said first shoulder, said central cylindrical body sidewall has inner and outer surfaces, said outer surface of said central cylindrical body sidewall at said second flange has a radial height less than the radial height of said outer surface of said central cylindrical body sidewall at said fourth shoulder and less than or equal to the radial height of said outer surface of said central cylindrical body sidewall at said third shoulder, said outer surface of said central cylindrical body sidewall at said third flange has a radial height less than the radial height of said outer surface of said central cylindrical body sidewall at said sixth shoulder and less than or equal to the radial height of said outer surface of said central cylindrical body sidewall at said fifth shoulder, said outlet cylindrical body sidewall has inner and outer surfaces, said outer surface of said outlet cylindrical body sidewall at said fourth flange has a radial height less than the radial height of said outer surface of said outlet cylindrical body sidewall at said eighth shoulder and less than or equal to the radial height of the outer surface of said outlet cylindrical body sidewall at said seventh shoulder, said inner surface of said inlet cylindrical body sidewall at said first flange has a radial height less than the radial height of said inner surface of said inlet cylindrical body sidewall at said second shoulder and less than or equal to the radial height of said inner surface of said inlet cylindrical body sidewall at said first shoulder, said inner surface of said central cylindrical body sidewall at said second flange has a radial height less than the radial height of said inner surface of said central cylindrical body sidewall at said fourth shoulder and less than or equal to the radial height of said inner surface of said central cylindrical body sidewall at said third shoulder, said inner surface of said central cylindrical body sidewall at said third flange has a radial height less than the radial height of said inner surface of said central cylindrical body sidewall at said sixth shoulder and less than or equal to the radial height of said inner surface of said central cylindrical body sidewall at said fifth shoulder, said inner surface of said outlet cylindrical body sidewall at said fourth flange has a radial height less than the radial height of said inner surface of said outlet cylindrical body sidewall at said eighth shoulder and less than or equal to the radial height of said inner surface of said outlet cylindrical body sidewall at said seventh shoulder, the radial height of said outer surface of said sidewall of one of said first and second flanges is substantially equal to the radial height of said inner surface of said sidewall of the other of said first and second flanges, the radial height of said outer surface of said sidewall of one of said third and fourth flanges is substantially equal to the radial height of said inner surface of said sidewall of the other of said third and fourth flanges.

8. The exhaust aftertreatment device according to claim 3 wherein said central section comprises a plurality of cylindrical bodies.

* * * * *